US010424876B1

(12) United States Patent
Bandoh et al.

(10) Patent No.: US 10,424,876 B1
(45) Date of Patent: Sep. 24, 2019

(54) CONNECTOR, ELECTRONIC DEVICE, AND METHOD FOR MOUNTING CONNECTOR

(71) Applicant: LENOVO (SINGAPORE) PTE. LTD., Singapore (SG)

(72) Inventors: Masaaki Bandoh, Yokohama (JP); Koji Yamauchi, Yokohama (JP); Jun Iwasaki, Yokohama (JP); Munefumi Nakata, Yokohama (JP)

(73) Assignee: LENOVO (SINGAPORE) PTE. LTD., Singapore (SG)

( * ) Notice: Subject to any disclaimer, the term of this patent is extended or adjusted under 35 U.S.C. 154(b) by 0 days.

(21) Appl. No.: 16/151,011

(22) Filed: Oct. 3, 2018

(30) Foreign Application Priority Data

Jul. 20, 2018 (JP) ..... 2018-136434

(51) Int. Cl.
*H01R 13/648* (2006.01)
*H01R 13/508* (2006.01)
*H01R 13/426* (2006.01)

(52) U.S. Cl.
CPC ..... *H01R 13/648* (2013.01); *H01R 13/426* (2013.01); *H01R 13/508* (2013.01)

(58) Field of Classification Search
CPC ..... H01R 13/6593; H01R 13/6594; H01R 13/6595; H01R 12/724
USPC ..... 439/607.27, 0.35, 0.4, 79
See application file for complete search history.

(56) References Cited

U.S. PATENT DOCUMENTS 4,929,195 A * 5/1990 Seidoh ..... H01R 13/6599 439/465
8,142,224 B2 * 3/2012 Wu ..... H01R 13/648 439/353
9,780,494 B2 * 10/2017 Chen ..... H01R 13/6581
10,050,373 B2 * 8/2018 Wang ..... H01R 13/5219

FOREIGN PATENT DOCUMENTS

JP 2005268018 A 9/2005

* cited by examiner

*Primary Examiner* — Hien D Vu
(74) *Attorney, Agent, or Firm* — Shimokaji IP

(57) ABSTRACT

A connector includes a terminal having one end soldered to a substrate; an insulating member that supports the terminal; a metal case that covers a part of the insulating member and the terminal; and a metal shield that is spot-welded to the case at several positions and covers an exposed part of the insulating member. The shield includes: an upper shielding part that covers the upper plate of the case; and an inner shielding part that bends from the end of the upper shielding part and reaches the mounting face of the substrate or a position close to the mounting face and covers the substrate-inward lateral face of the insulating member. The inner shielding part has ground posts.

8 Claims, 10 Drawing Sheets

CONNECTOR, ELECTRONIC DEVICE, AND METHOD FOR MOUNTING CONNECTOR

FIELD OF THE INVENTION

The present invention relates to a connector having a terminal soldered to a substrate at one end, an insulating member that supports the terminal, and a metal case that covers a part of the insulating member and the terminal. The present invention also relates to an electronic device including such a connector and a method for mounting such a connector.

BACKGROUND OF THE INVENTION

Many electronic devices include a connector for signal connection with external devices. Such a connector is typically mounted on a substrate of the electronic device. Since the signal speed increases, countermeasure against EMI (electromagnetic interference) is required to prevent the EMI from the connector to the surrounding environment. For such countermeasure against EMI, Japanese Unexamined Patent Application Publication No. 2005-268018, for example, proposes a shield surrounding a connector.

Meanwhile recently developed electronic devices, such as laptop or tablet PCs and smartphones, are thin, and so a substrate and a connector have to be arranged in a limited space. For a substrate that is displaced closer to one end of the chassis in the thickness direction due to such limitations of the space, the substrate accordingly has offset from the connector. The connector has terminals protruding upward from the mounting face of the substrate, extending outward of the substrate, and then descending toward the rear face of the substrate. When the offset between the substrate and the connector increases, the length of such a descending part of the terminal increases. A part surrounding the descending part then generates electromagnetic waves as noise like a loop antenna, and so the shielding has to be devised more.

As shown in FIG. 10, a connector 502 to be mounted on a substrate 500 may have an opening 506 that is not covered with a metal case 504 on the inside of the substrate because of a manufacturing reason. Electromagnetic waves easily leak from such an opening 506, and so the opening is desirably covered with a shield 508. The shield 508 is electrically continuous with the case 504 through a conductive tape 510 and is electrically continuous with the ground line via a plurality of surface-mounted clips 512. The case 504 is typically connected to a ground.

SUMMARY OF THE INVENTION

When the conductive tape 510 is used for the continuity as in FIG. 10, the operator has to attach the conductive tape 510. The clips 512 for continuity also require the operator to have a good skill of inserting the end of the shield 508 into the clips 512 and require visual inspection after the insertion. The number of components also increases due to the clips 512.

While an automated machine can mount the case 504 as the body and the clips 512, the operator has to conduct manual procedures to attach the conductive tape 510 and mount the shield 508.

Sufficiently low-resistance continuity cannot be obtained from the conductive tape 510 and the clips 512, and so the ability of shielding electromagnetic waves is not always so high. Stronger electromagnetic waves as noise will be expected due to a higher speed of signals and an increasing offset due to a thinner chassis, and so the improvement of shielding ability is required.

In view of the above, the present invention aims to provide a connector that can be easily mounted and has improved shielding ability of electromagnetic waves as noise and provide an electronic device and a method for mounting a connector.

To solve the problems and achieve the aim, a connector according to the first aspect of the present invention includes a terminal having one end soldered to a substrate, an insulating member that supports the terminal, a metal case that covers a part of the insulating member and the terminal, and a metal shield that is spot-welded to the case at several positions and covers at least a part of an exposed part of the insulating member.

An electronic device according to the second aspect of the present invention includes a connector including: a terminal having one end soldered to a substrate; an insulating member that supports the terminal; and a metal case that covers a part of the insulating member and the terminal. The connector is spot-welded to the case at several positions, and includes a metal shield that covers at least a part of an exposed part of the insulating member.

A method for mounting a connector according to the third aspect of the present invention is to mount a connector on a substrate, the connector including: a terminal having one end soldered to the substrate; an insulating member that supports the terminal; and a metal case that covers a part of the insulating member and the terminal. The method includes: welding a metal shield that covers at least a part of an exposed part of the insulating member to the case at several positions by spot-welding; mounting the connector at a prescribed position of the substrate; and soldering ground posts of the case and the shield to a ground line of the substrate.

These aspects can simplify the mounting procedures without using a conductive tape and clips. Favorable continuity also can be obtained from spot-welding and so the ability of shielding electromagnetic waves as noise can improve.

The terminal may include: an ascending part extending upward from an upper face of the substrate; a substrate-end upper part extending from the end of the ascending part and beyond the end of the substrate in the outwardly direction of substrate; a descending part extending downward from the end of the substrate-end upper part; and a contact part extending from the descending part in the outwardly direction of the substrate. The insulating member may support the ascending part, the case may have an upper plate that covers the upper face of the insulating member, and the shield may include: an upper shielding part that covers the upper plate; and an inner shielding part that bends from the end of the upper shielding part and covers at least a part of a substrate-inward lateral face of the insulating member. Such an inner shielding part can shield electromagnetic noise from the substrate-inward lateral face of the insulating member.

The case and the inner shielding part may have ground posts soldered to the ground line of the substrate. This can improve the ability of shielding more.

The inner shielding part may have three ground posts. This can achieve sufficient ability of shielding, and wiring pattern is allowed to pass through between the ground posts.

The spot weld may be disposed at one or more positions close to each of the ground posts. This can improve the ability of shielding more.

The spot weld at least at one position may be directly welded to the ground posts. This can improve the ability of shielding more.

The insulating member may include a descending-part supporting part that supports the descending part, the shield may include an extension that extends from the descending-part supporting part in the outward direction of the substrate, and the spot weld may be disposed at the extension at least at one position. This can shield electromagnetic noise from the descending-part supporting part toward the outside of the substrate.

The above described aspects of the present invention, which includes a metal shield that is spot-welded to a case at several positions, can simplify the mounting procedures without attaching a conductive tape and inserting clips. Favorable continuity also can be obtained from spot-welding and so the ability of shielding of electromagnetic waves as noise can improve.

DETAILED DESCRIPTION OF THE INVENTION

The following describes one embodiment of a connector, an electronic device and a method for mounting a connector according to the present invention in details, with reference to the drawings. The present invention is not limited to the following embodiment.

Figure 1:
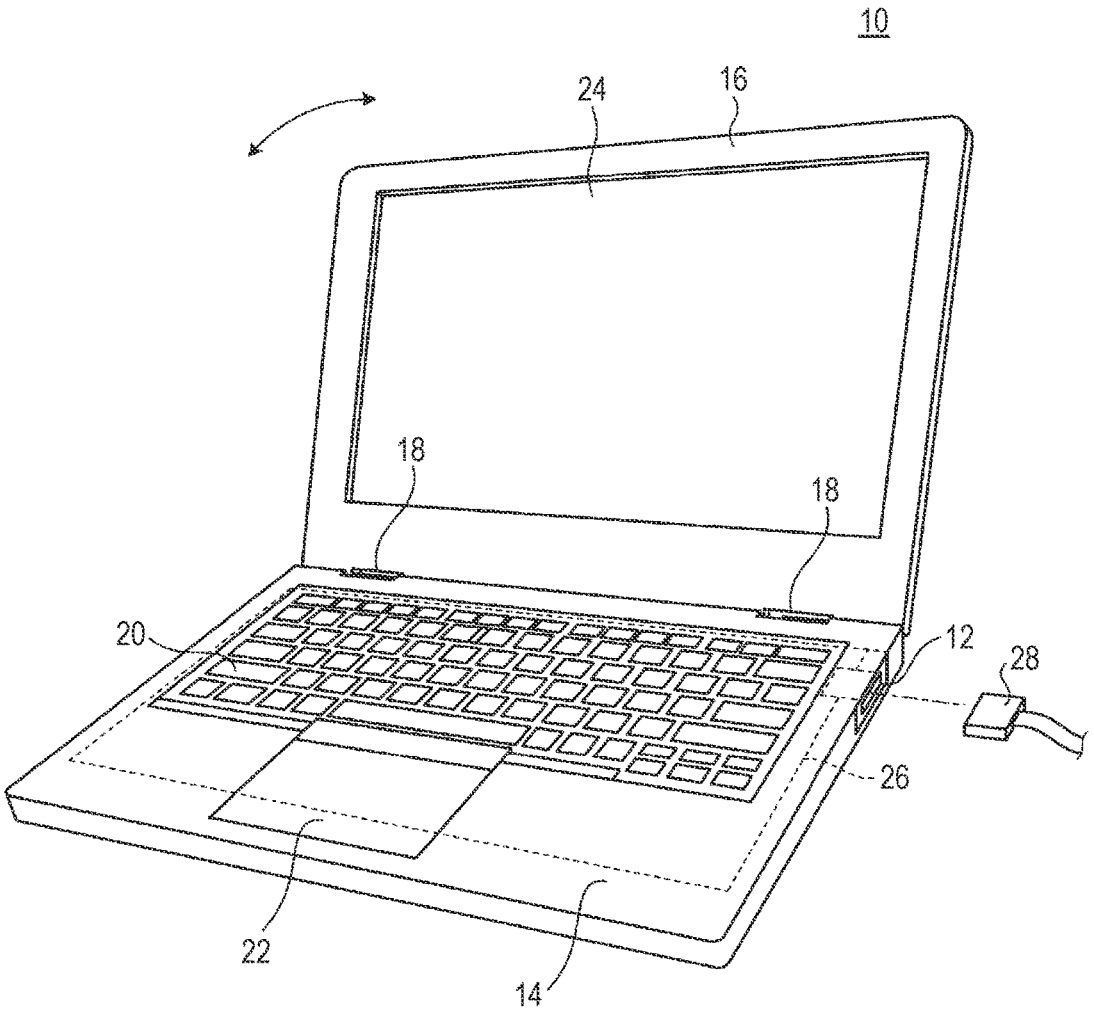
FIG. 1 is a perspective view of a laptop PC according to one embodiment.

FIG. 1 is a perspective view of a laptop PC 10 as an electronic device according to one embodiment of the present invention, and shows a connector 12 according to one embodiment of the present invention. The electronic device according to the present invention is not limited to a laptop PC 10, which may be a desktop PC or a mobile tablet.

This laptop PC 10 includes a chassis 14 and a lid 16 that is openable/closable relative to the chassis via hinges 18. The laptop PC with the lid 16 closed is compact and is suitable for mobile use.

The upper face of the chassis 14 includes a keyboard unit 20 and a touchpad 22. The front face of the lid 16 includes a display 24 that accounts for a major part of the area as well as a speaker and a camera that are not illustrated.

The chassis 14 includes a connector 12 according to one embodiment of the present invention. The connector 12 is disposed at an end of a substrate 26 in the chassis 14, and has a fitting part laterally exposed from the chassis 14. The substrate 26 is displaced closer to the below in FIG. 1 to make the chassis 14 thinner. On the contrary, the position of the connector 12 is fixed, which increases the offset between the substrate 26 and the connector 12 to some extent. The connector 12 is to output images and sound to the outside, for example, and is for high-speed signals. The connector 12 connects to a plug 28 for signal transmission with external devices.

For the purpose of illustration, the side of the connector 12 facing the plug 28 is called the substrate-outward direction and the opposite side is called the substrate-inward direction. The extending direction of the substrate-outward direction and the substrate-inward direction is called a front-rear direction and the direction orthogonal to the front-rear direction is called a width direction. For the vertical direction, the direction is defined relative to the substrate 26. The side of the mounting face (the upper face of the substrate) 26*a* where the terminals 30 of the connector 12 are mounted (see FIG. 6) is called upside, and the face 26*b* on the opposite side is called downside. Typically the mounting face 26*a* is to mount many components in addition to the connector 12. Note here that the vertical direction as stated above is reversed about up and down from FIG. 1 that shows the laptop PC 10 as a whole.

Figure 2:
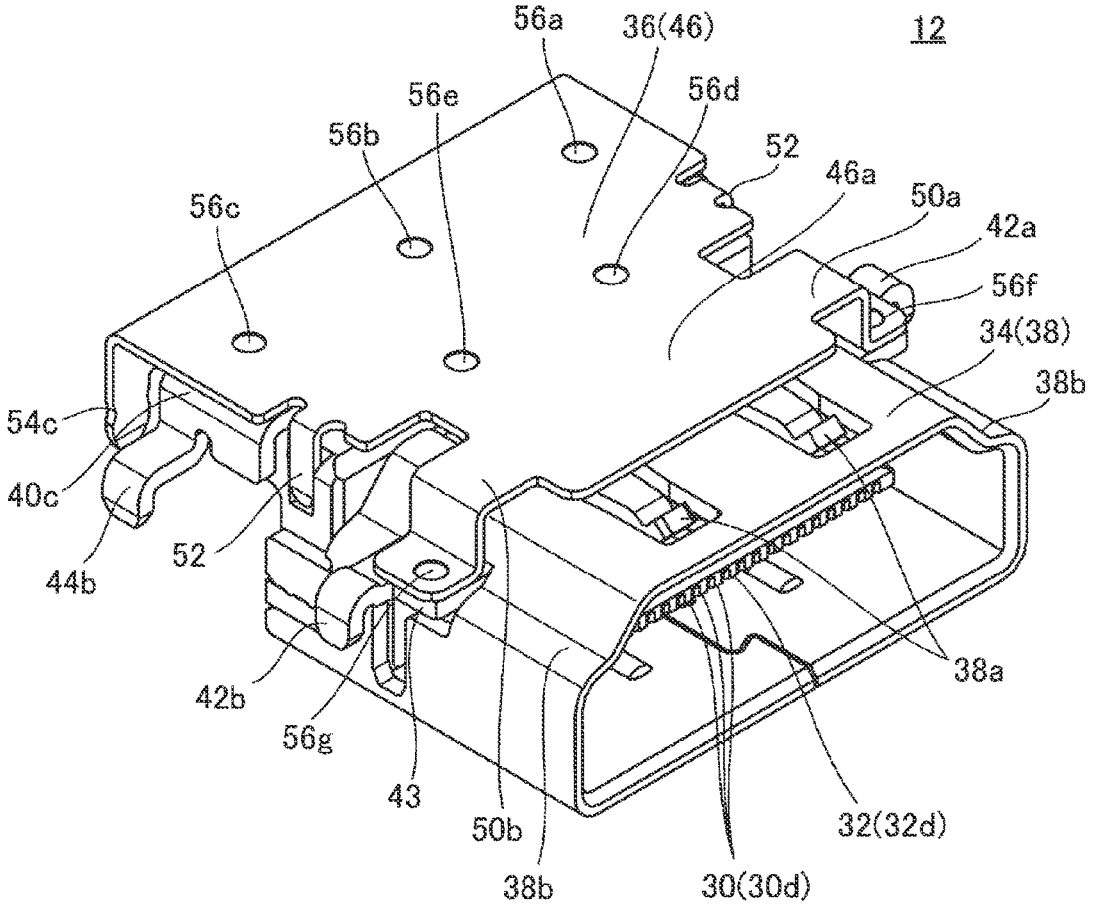
FIG. 2 is a perspective view of a connector according to one embodiment viewed obliquely from the outside.
Figure 3:
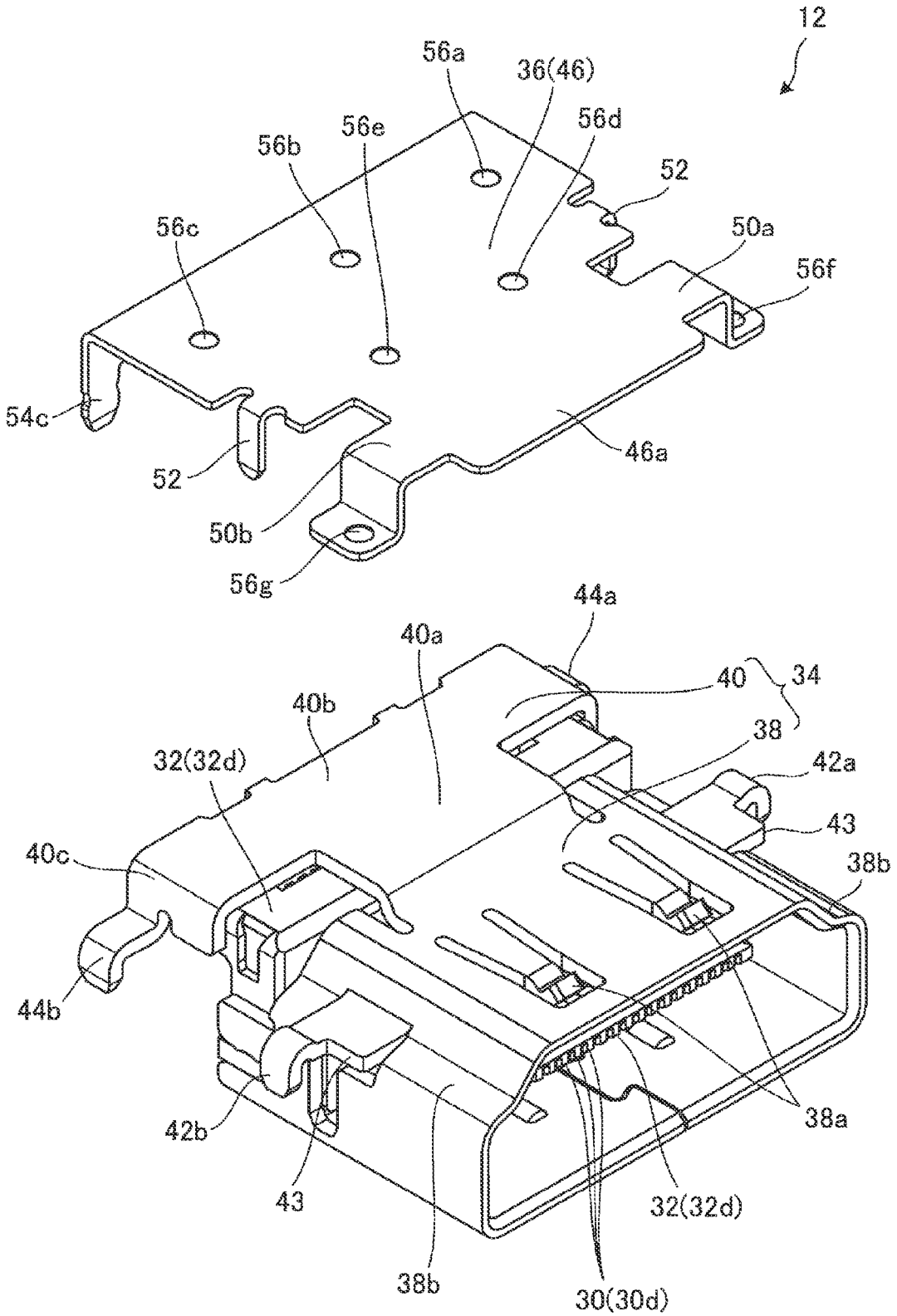
FIG. 3 is an exploded perspective view of a connector according to one embodiment viewed obliquely from the outside.
Figure 4:
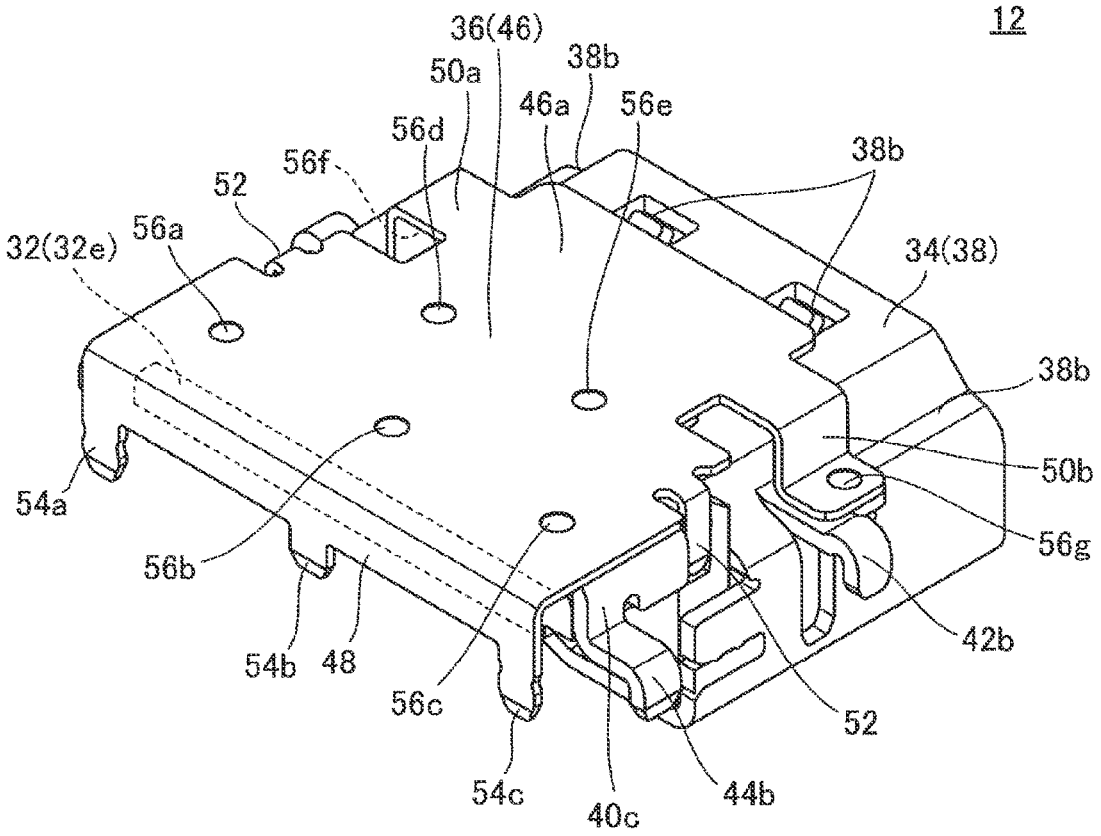
FIG. 4 is a perspective view of a connector according to one embodiment viewed obliquely from the inside.

FIG. 2 is a perspective view of the connector 12 obliquely from the outside, and FIG. 3 is an exploded perspective view of the connector 12 obliquely from the outside. FIG. 4 is a perspective view of the connector 12 obliquely from the inside, and FIG. 5 is an exploded perspective view of the connector 12 obliquely from the inside.

Figure 5:
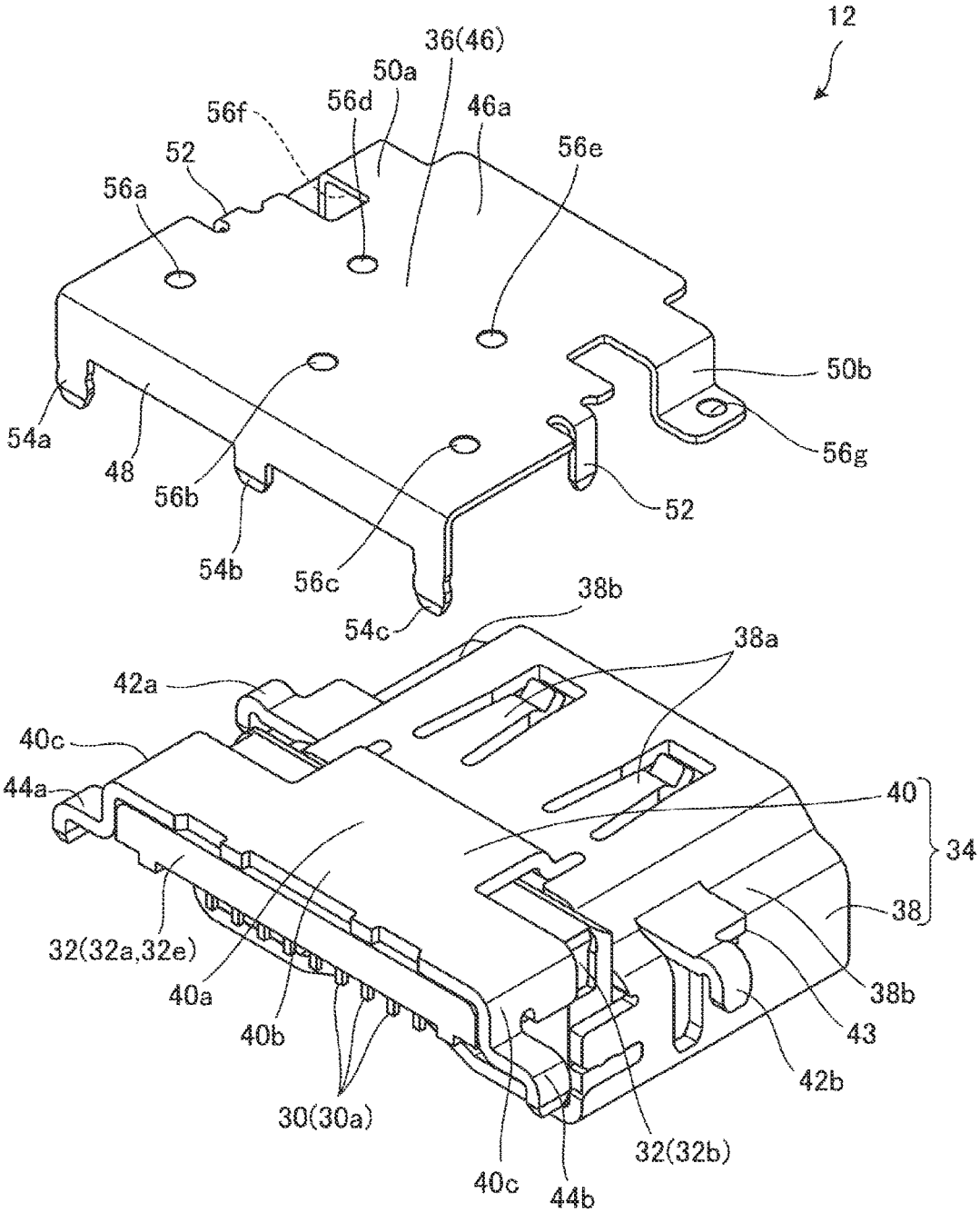
FIG. 5 is an exploded perspective view of a connector according to one embodiment viewed obliquely from the inside.

As shown in FIGS. 2, 3, 4 and 5, the connector 12 includes a plurality of parallel terminals 30, an insulating member 32 that supports the terminals, a metal case 34 that covers a large part of the insulating member 32 and the terminals 30, and a metal shield 36. The case 34 and the shield 36 are made of SUS (Steel Use Stainless) materials, for example. FIGS. 3 and 5 show the connector when the shield 36 is detached from the case 34.

Figure 6:
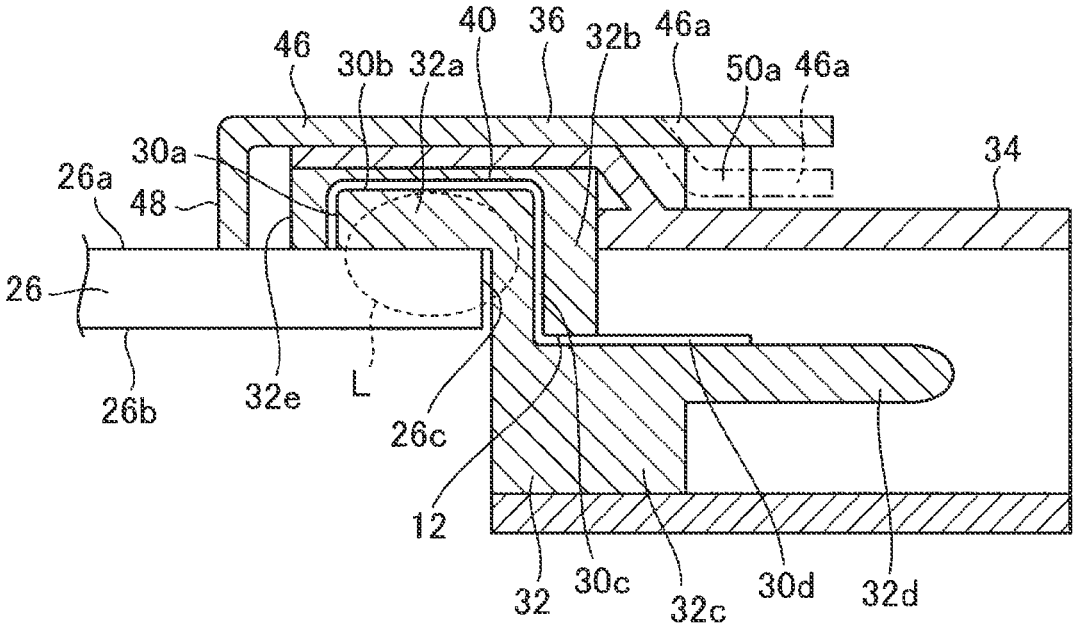
FIG. 6 is a cross-sectional view of a connector according to one embodiment.

FIG. 6 is a cross-sectional view of the connector 12. As shown in FIG. 6, the terminals 30 include an ascending part 30*a* extending upward from the mounting face 26*a*, a substrate-end upper part 30*b* extending from the end of the ascending part 30*a* and beyond the end of the substrate 26 in the substrate-outward direction, a descending part 30*c* extending downward from the end of the substrate-end upper part 30*b*, and a contact part 30*d* extending from the descending part 30*c* in the substrate-outward direction. The contact part 30*d* electrically connects to terminals of the plug 28 (see FIG. 1). The terminals 30 are soldered to the substrate 26 at the lower end of the ascending part 30*a*.

The insulating member 32 is a plastic molded product, for example, and includes a substrate upper part 32*a*, a descending-part supporting part 32*b*, a substrate lower part 32*c* and a tongue 32*d*. The substrate upper part 32*a* comes in contact with the mounting face 26*a* at the lower part and covers all of the ascending part 30*a* and a part of the substrate-end upper part 30*b* for support. The descending-part supporting part 32*b* is located outside of the substrate 26, and covers all of the descending part 30*c* and a part of the substrate-end upper part 30*b* for support. The substrate lower part 32*c* is continuous with the descending-part supporting part 32*b* and reaches the lower plate of the case 34. The tongue 32*d* protrudes from the upper part of the substrate lower part 32*c* in the substrate-outward direction. The contact part 30*d* of the terminals 30 has a proximal end included in the descending-part supporting part 32*b*, center part supported by the substrate lower part 32*c* and a distal end supported by the tongue 32*d*.

The offset between the substrate 26 and the connector 12 can be a difference in height between the mounting face 26*a* and the tongue 32*d*. A larger offset means a longer descending part 30*c*. A longer descending part 30*c* means a larger region L surrounded by the ascending part 30*a*, the substrate-end upper part 30*b* and the descending part 30*c* on the three sides. This region L can generate electromagnetic noise due to the action similar to a loop antenna, and such electromagnetic noise can be shielded as described later.

Referring back to FIGS. 2 to 5, the case 34 has a base tube 38 and an upper plate 40. The base tube 38 is a substantially quadrangle tubular shape that is flattened, and covers the substrate lower part 32*c*, the tongue 32*d* and the contact part 30*d* on the four sides. The base tube 38 includes two claws 38*a* on the upper face, and these claws elastically press the plug 28 when the plug is inserted. The base tube 38 has dents 38*b* at the upper parts of both lateral faces and the dents extend in the front-rear direction.

The upper plate 40 has a substantially T-letter shape that is flattened in a planar view, and the width of the upper plate is smaller at a substrate-outward part 40*a* and is larger at a substrate-inward part 40*b*. The upper plate 40 has a substrate-outward end that is connected to the upper face of the base tube 38 so that the substrate-outward end is slightly higher than the upper face of the base tube. At both ends of the substrate-inward part 40*b*, downward bending parts 40*c* are formed. The substrate-inward part 40*b* and the bending parts 40*c* cover the substrate upper part 32*a*, the ascending part 30*a* and the substrate-end upper part 30*b* at the upper face and both of the lateral faces. The substrate-outward part 40*a* covers a part of the descending-part supporting part 32*b*.

While most of the insulating member 32 closer to the region L as stated above (see FIG. 6) is covered with the upper plate 40, the entire face of a substrate-inward lateral face 32*e* of the substrate upper part 32*a* and a part of the descending-part supporting part 32*b* are exposed.

Particularly the substrate-inward lateral face 32*e* is relatively wide and can generate electromagnetic waves as noise from the region L. The shield 36 can shield such electromagnetic waves and can sufficiently suppress the leakage to the outside. The lower face of the insulating member 32 facing the mounting face 26*a* can be shielded by the ground of the substrate 26.

The case 34 also includes ground posts 42*a* and 42*b* and ground posts 44*a* and 44*b* that are soldered to the ground line of the substrate 26. The ground posts 42*a* and 42*b* are disposed at the dents 38*b* of the base tube 38 on both sides. These ground posts are prepared by cutting a part of the base tube 38 so as to protrude laterally, and have a hook shape at the leading end that bends downward. Each of the ground posts 42*a* and 42*b* has a step to define a lateral face 43. Each of the ground posts 44*a* and 44*b* laterally protrudes from a part of the bending part 40*c* and has a hook shape at the leading end that bends downward. The downward leading ends of the ground posts 42*a*, 42*b*, 44*a* and 44*b* reach a position slightly below the dents 38*b*.

The shield 36 includes an upper shielding part 46 that is relatively wide, an inner shielding part 48 that bends from the substrate-inward end of the upper shielding part 46, supporting pieces 50*a* and 50*b* and a pair of clamping pieces 52.

As shown in FIG. 6, the upper shielding part 46 of the shield 36 has an extension 46*a* that extends beyond the substrate upper part 32*a* and the descending-part supporting part 32*b* surrounding the region L of the insulating member 32 in the substrate-outward direction. The extension 46*a*, as a part of the upper shielding part 46, covers substantially half of the upper face of the base tube 38, and the remaining part comes in contact with the upper plate 40 to cover the entire upper face of the upper plate. The extension 46*a* is disposed away from the base tube 38, and does not interfere with the claws 38*a* that move vertically to some extent. As indicated with the virtual line, the extension 46*a* may be brought closer to the base tube 38 in accordance with the step of the case 34. The shield 36 has a simple shape and so can be manufactured easily. The inner shielding part 48 reaches the mounting face 26*a* of the substrate 26 or reaches the vicinity of the mounting face so as to cover the substrate-inward lateral face 32*e* of the insulating member 32. The inner shielding part 48 may cover at least a part of the substrate-inward lateral face 32*e*, from which a corresponding advantageous effect can be obtained.

Referring back to FIGS. 2 to 5, the supporting pieces 50*a* and 50*b* slightly protrude laterally from both sides of the extension 46*a* close to the substrate-outward end, bend downward, and then bend further laterally. The leading ends of these supporting pieces 50*a* and 50*b* are mounted on the upper faces of the laterally protruding parts of the ground posts 42*a* and 42*b*, respectively, to support the shield 36. The clamping pieces 52 are disposed on both sides at a substantially center position in the front-rear direction, and protrude downward. The clamping pieces 52 clamp both sides of the insulating member 32 for supporting.

The inner shielding part 48 has three ground posts 54*a*, 54*b* and 54*c* that are soldered to the ground line of the substrate 26. The ground posts 54*a* to 54*c* are disposed at both ends and a center position in the width direction of the inner shielding part 48, and protrude downward. Each of the ground posts 54*a* to 54*c* has an appropriate width, and enough distance is kept between the ground post 54*a* and the ground post 54*b* and between the ground post 54*b* and the ground post 54*c*.

The shield 36 is spot-welded to the case 34 at seven positions. These welding points 56*a*, 56*b*, 56*c*, 56*d*, 56*e*, 56*f*, and 56*g* may be collectively called a spot weld 56.

The welding points 56*a*, 56*b* and 56*c* are aligned in the width direction, which are welded to the substrate-inward part 40*b*. The welding point 56*a* is close to the ground posts 54*a* and 44*a*. The welding point 56*b* is close to the ground post 54*b*. The welding point 56*c* is close to the ground posts 54*c* and 44*b*. The welding points 56*d* and 56*e* are aligned in the width direction, which are welded close to both ends of the substrate-outward part 40*a* in the width direction. The welding point 56*f* is at the supporting piece 50*a*, and is directly welded to the ground post 42*a*. The welding point 56*g* is at the supporting piece 50*b*, and is directly welded to the ground post 42*b*. In this way, the shield 36 is welded to the case 34 at appropriately many positions and evenly in the front-rear direction and in the width direction. This can achieve good continuity with the case 34 over the entire face and the welding strength also can increase.

Figure 7:
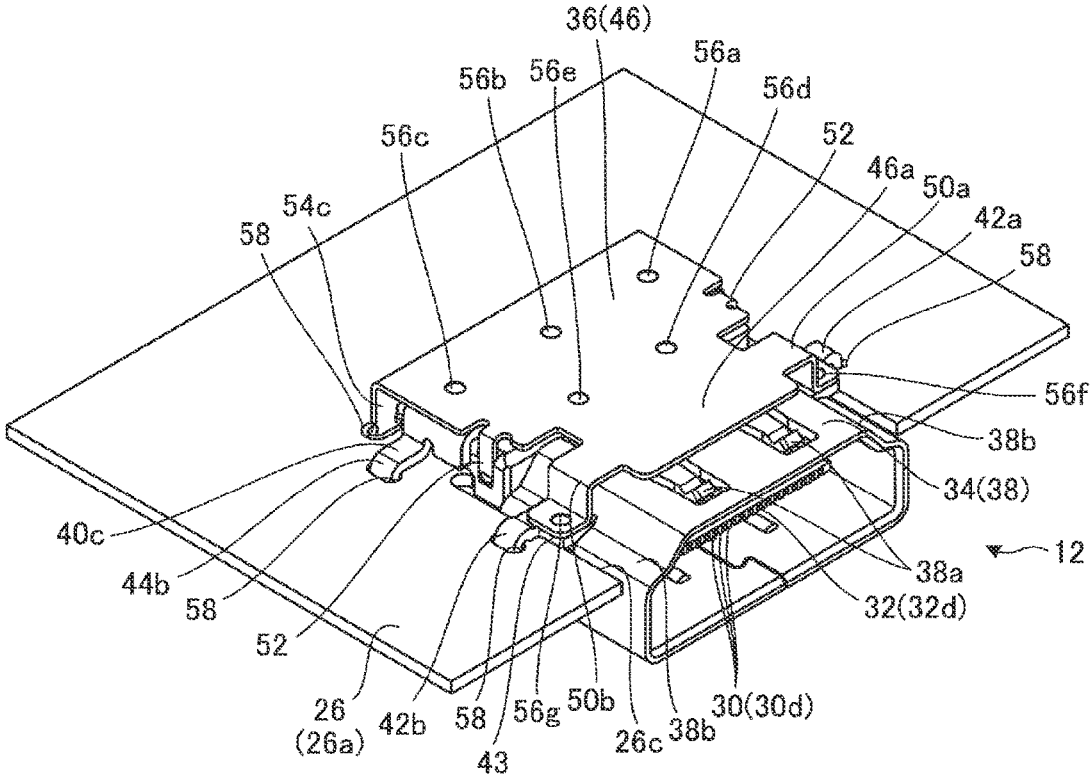
FIG. 7 is a perspective view of a connector mounted on a substrate viewed obliquely from the outside.
Figure 8:
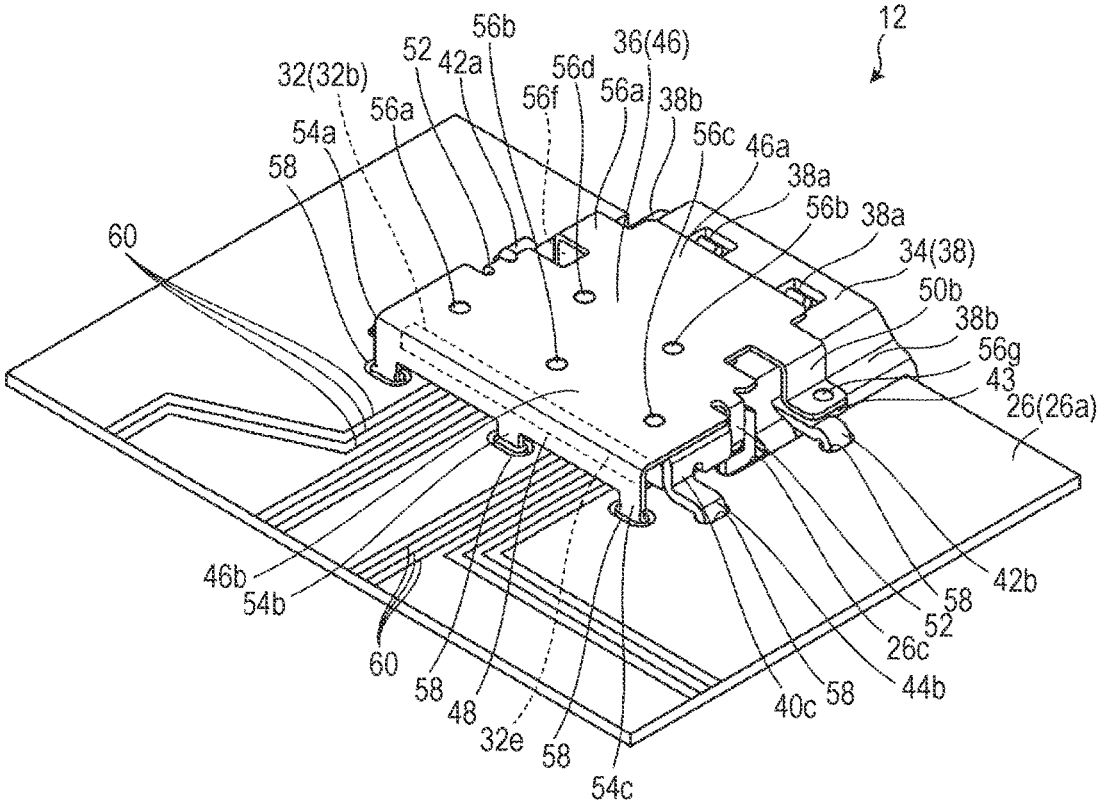
FIG. 8 is a perspective view of a connector mounted on a substrate viewed obliquely from the inside.

As shown in FIGS. 7 and 8, the connector 12 is mounted at the end of the substrate 26 so that a part of the connector is fitted into a rectangular cutout 26*c*. More specifically a part of the base tube 38 below the dents 38*b* is fitted into the rectangular cutout 26*c*, and the substrate upper part 32*a* of the insulating member 32 is mounted on the mounting face

26*a* (see FIG. 6 as well). The leading end of the base tube 38 slightly protrudes from the end of the substrate 26 in the substrate-outward direction.

The ground posts 42*a*, 42*b*, 44*a*, 44*b*, 54*a*, 54*b* and 54*c* (hereinafter collectively called a ground post P) are fitted into corresponding through-holes 58 that are slots and are soldered. The ground post P has an appropriate thickness and is fitted into the through holes 58 for soldering. This configuration has very small resistance and is strong. The through holes 58 connect to the ground line of the substrate 26, so that the case 34 and the shield 36 are electrically connected to the ground. The ascending part 30*a* of the terminals 30 (see FIG. 6) is fitted into a through hole not illustrated for soldering. The lateral step parts of the ground posts 42*a*, 42*b*, 44*a* and 44*b* are placed on the mounting face 26*a* to stabilize the connector 12 vertically for positioning. Each of the lateral faces 43 of the ground posts 42*a* and 42*b* comes into contact with the cut-out face of the rectangular cutout 26*c* to stabilize the connector 12 in the width direction for positioning.

In this way, when the connector 12 is mounted on the substrate 26, the shield 36 covers substantially all of the exposed part of the insulating member 32. This can prevent the leakage of electromagnetic waves as noise that are generated at the region L (see FIG. 6) as stated above, for example. The shield 36 is spot-welded to the case 34 at several positions, from which favorable continuity can be obtained as compared with the conductive means, such as a conductive tape, and a high shielding effect can be obtained. The shield 36 may cover at least a part of the exposed part of the insulating member 32, from which a corresponding advantageous effect can be obtained.

Specifically the substrate-inward lateral face 32*e* of the insulating member 32 is not covered with the case 34, and is covered with the inner shielding part 48 of the shield 36. The inner shielding part 48 then connects to the ground line via the ground posts 54*a* to 54*c*, and parts close to the ground posts 54*a* to 54*c* are spot-welded to the case 34 at the welding points 56*a* to 56*c*. With this configuration, the shielding effect is high, and electromagnetic noise generated there can be shielded.

The case 34 and the inner shielding part 48 are soldered to the ground line of the substrate 26 via the ground post P. This configuration does not have contact resistance as in the clips and has direct continuity, and so the shielding effect can increase. Since no clips are required, the number of components accordingly decreases, and the cost decreases.

The inner shielding part 48 has the ground posts 54*a* to 54*c* at three positions including both ends and a center, and has good electrical and mechanical balance. Since appropriate intervals also are kept, a wiring pattern 60 (see FIG. 8) is allowed to pass through between the ground posts.

Since the spot welds 56 are close to the ground posts P, the ground of the shield 36 is enhanced, and so the shielding effect can increase. Particularly, the welding parts 56*f* and 56*g* are directly welded to the ground posts 42*a* and 42*b*, and so favorable continuity can be obtained with the ground. The shield 36 is spot-welded to the case 34, and the ground post P is soldered to the substrate 26. With this configuration, conductive resistance does not change with time, and the bonding strength and vibration resistance are high and reliable.

The extension 46*a* of the upper shielding part 46 extends beyond the descending-part supporting part 32*b* in the substrate-outward direction, which can prevent the leakage of electromagnetic noise from the region L more effectively. This extension 46*a*, disposed away from the base tube 38, is directly welded to the ground posts 42*a* and 42*b* at the two positions of the weld points 56*f* and 56*g*. This can lead to a favorable shielding effect. The spot weld disposed at least at one position of the extension 46*a* can lead to a corresponding advantageous effect.

Figure 10:
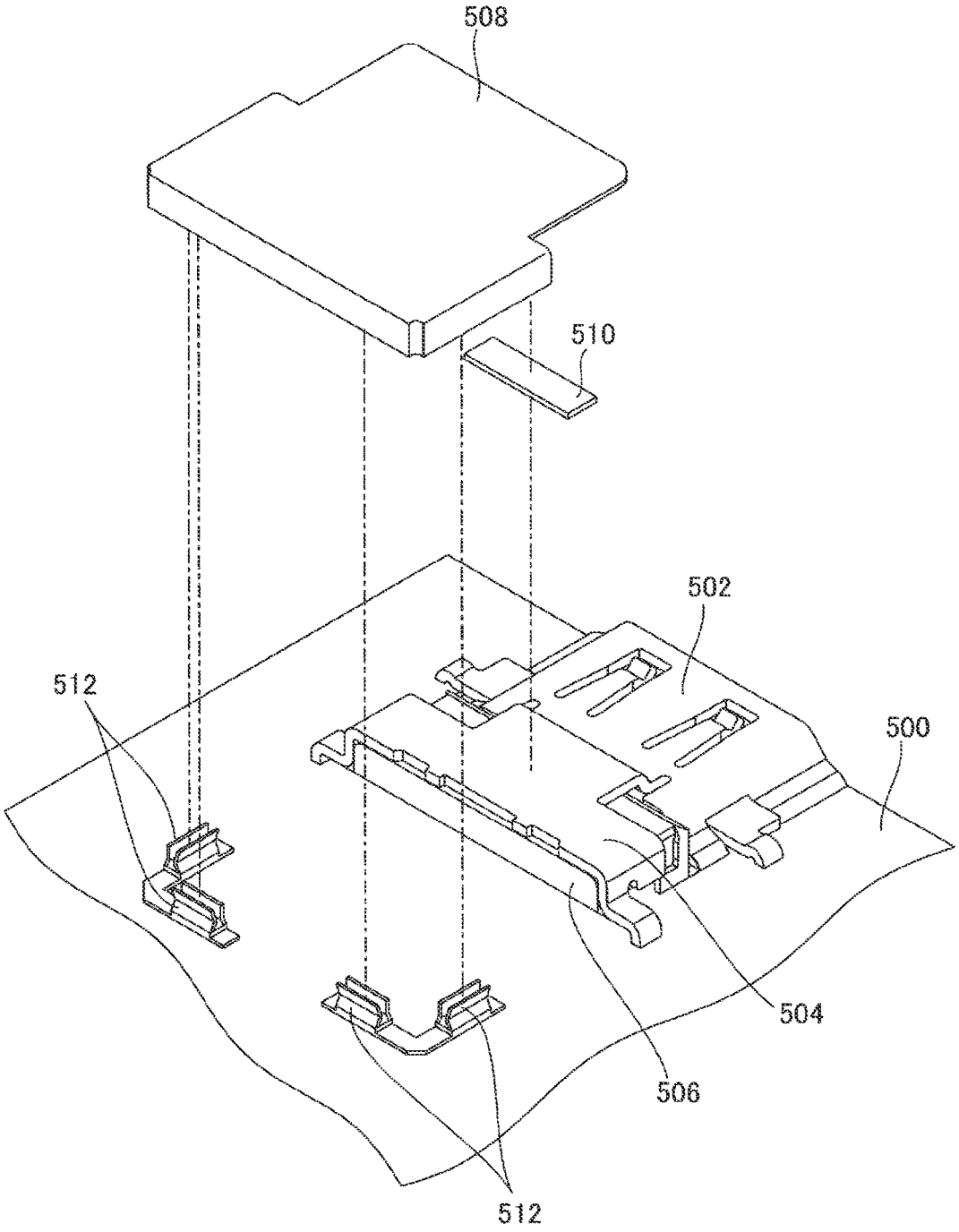
FIG. 10 is an exploded perspective view of a conventional connector viewed obliquely from the inside.

The thus configured connector 12 can have a high shielding effect of electromagnetic noise. The experiment by the present inventors showed that the connector improved the effect by about 7 dB as compared with the combination of a connector 502 and a shield 508 (see FIG. 10) according to the conventional technique.

Figure 9:
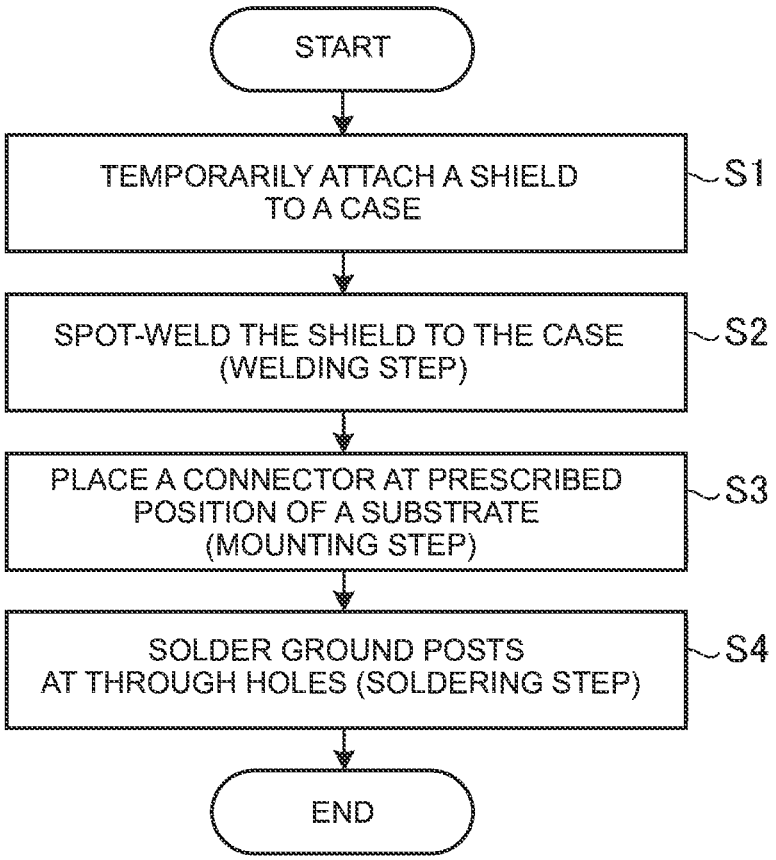
FIG. 9 is a flowchart showing the procedure of a method for mounting a connector according to one embodiment.

The following describes a method for mounting a connector according to one embodiment, which is a method for mounting the connector 12 to the substrate 26, with reference to FIG. 9.

To mount the connector 12, the shield 36 is temporarily attached to the case 34 at Step S1. The shield 36 covers the exposed part of the insulating member 32 other than a part facing the mounting face of the substrate 26. The pair of clamping pieces 52 of the shield 36 holds the insulating member 32 with an appropriate force from both sides, so that the shield can be temporarily attached without falling. This can facilitate the following welding step.

Next at the welding step of Step S2, the shield 36 is spot-welded to the case 34 at seven welding points of 56*a* to 56*g*. The insulating member 32 and the terminals 30 may be mounted to the case 34 before or after the welding step. In this way, the connector 12 can be obtained. Note here that the welding step may be included in the method for manufacturing the connector 12, and the welding step may be included in a mounting method in a broad sense.

Next, the obtained connector 12 is placed at a prescribed position of the substrate 26 at the mounting step of Step S3. At this step, the ground post P is inserted into the through holes 58, and the terminals 30 is inserted into a through hole not illustrated (see FIG. 8). A part of the base tube 38 below the dents 38*b* is substantially disposed below the substrate 26. This mounting step may include mounting of other electrical components by an automated machine, for example.

Next at the soldering step of Step S4, the ground post P is soldered at the through holes 58 for continuity with the ground line of the substrate 26. This soldering step may be conducted concurrently with the soldering of the terminal 30. Soldering may be conducted to other electrical components as well using a furnace or a tank.

Such a method for mounting the connector 12 spot-welds the shield 36 to the case 34, and adhesive means or step like a conductive tape is not required. Since the ground post P is soldered to the through holes 58, the skill like fastening with clips is not required for operators. Visual inspection after clipping also is not required. Most of the steps of the method for mounting the connector 12 can be automated, and so the productivity of the method is excellent.

The present invention is not limited to the above-described embodiment, and can be modified freely without deviating from the scope of the present invention.

The invention claimed is:

1. An electrical connector comprising:

a terminal having one end soldered to a substrate;

an insulating member that supports the terminal;

a metal case that covers a part of the insulating member and the terminal; and a metal shield that is spot-welded to the metal case at several positions and covers at least a part of an exposed part of the insulating member, wherein:

the terminal includes at least:

an ascending part extending upward from an upper face of the substrate:

a substrate-end upper part extending from an end of the ascending part and beyond an end of the substrate in an outward direction of the substrate;

a descending part extending downward from the end of the substrate-end upper part; and a contact part extending from the descending part in the outward direction of the substrate, the insulating member supports the ascending part, the metal case has an upper plate that covers an upper face of the insulating member, and the metal shield includes at least:

an upper shielding part that covers the upper plate; and an inner shielding part that bends from an end of the upper shielding part and covers at least a part of a substrate-inward lateral face of the insulating member.

2. The electrical connector according to claim 1, wherein:

the metal case and the inner shielding part have ground posts that are soldered to a ground line of the substrate.

3. The electrical connector according to claim 2, wherein:

the inner shielding part has three of the ground posts.

4. The electrical connector according to claim 2, wherein:

the spot weld is disposed at one or more positions close to each of the ground posts.

5. The electrical connector according to claim 2, wherein:

the spot weld at least at one position is directly welded to the ground posts.

6. The electrical connector according to claim 1, wherein:

the insulating member includes a descending-part supporting part that supports the descending part, the metal shield includes an extension that extends from the descending-part supporting part in the outward direction of the substrate, and the spot weld is disposed at the extension at least at one position.

7. An electronic device comprising:

an electrical connector including at least:

a terminal having one end soldered to a substrate;

an insulating member that supports the terminal; and a metal case that covers a part of the insulating member and the terminal, wherein:

the connector is spot-welded to the metal case at several positions, and includes at least a metal shield that covers at least a part of an exposed part of the insulating member, the terminal includes at least:

an ascending part extending upward from an upper face of the substrate;

a substrate-end upper part extending from an end of the ascending part and beyond an end of the substrate in an outward direction of the substrate;

a descending part extending downward from the end of the substrate-end upper part; and a contact part extending from the descending part in the outward direction of the substrate, the insulating member supports the ascending part, the metal case has an upper plate that covers an upper face of the insulating member, and the metal shield includes at least:

an upper shielding part that covers the upper plate; and an inner shielding part that bends from an end of the upper shielding part and covers at least a part of a substrate-inward lateral face of the insulating member.

8. A method for mounting an electrical connector on a substrate, the connector including at least: a terminal having one end soldered to the substrate; an insulating member that supports the terminal; and a metal case that covers a part of the insulating member and the terminal, wherein:

the terminal includes at least:

an ascending part extending upward from an upper face of the substrate;

a substrate-end upper part extending from an end of the ascending part and beyond an end of the substrate in an outward direction of the substrate;

a descending part extending downward from the end of the substrate-end upper part; and a contact part extending from the descending part in the outward direction of the substrate, the insulating member supports the ascending part, the metal case has an upper plate that covers an upper face of the insulating member, and the metal shield includes at least:

an upper shielding part that covers the upper plate; and an inner shielding part that bends from an end of the upper shielding part and covers at least a part of a substrate-inward lateral face of the insulating member, the method comprising:

welding a metal shield that covers at least a part of an exposed part of the insulating member to the metal case at several positions by spot-welding;

mounting the connector at a prescribed position of the substrate; and soldering ground posts of the case and the shield to a ground line of the substrate.

* * * * *